US010273955B2

(12) United States Patent
Bean et al.

(10) Patent No.: US 10,273,955 B2
(45) Date of Patent: Apr. 30, 2019

(54) PISTON CARTRIDGE FOR PISTON PUMP

(71) Applicant: Caterpillar Inc., Peoria, IL (US)

(72) Inventors: Sunil J. Bean, Woodridge, IL (US); Cory A. Brown, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 162 days.

(21) Appl. No.: 15/352,284

(22) Filed: Nov. 15, 2016

(65) Prior Publication Data

US 2018/0135622 A1 May 17, 2018

(51) Int. Cl.

| | |
|---|---|
| ***F04B 53/16*** | (2006.01) |
| ***F04B 15/08*** | (2006.01) |
| ***F04B 9/109*** | (2006.01) |
| ***F04B 53/14*** | (2006.01) |
| ***F04B 23/02*** | (2006.01) |
| ***F04B 1/12*** | (2006.01) |
| ***F04B 9/117*** | (2006.01) |

(52) U.S. Cl.

CPC ..... *F04B 53/166* (2013.01); *F04B 1/12* (2013.01); *F04B 1/122* (2013.01); *F04B 1/128* (2013.01); *F04B 9/109* (2013.01); *F04B 9/1176* (2013.01); *F04B 15/08* (2013.01); *F04B 23/021* (2013.01); *F04B 53/14* (2013.01); *F04B 53/144* (2013.01); *F04B 53/168* (2013.01); *F04B 2015/081* (2013.01)

(58) Field of Classification Search

CPC .... F04B 9/1176; F04B 53/166; F04B 53/168; F16J 10/04

USPC ..... 92/71, 171.1

See application file for complete search history.

(56) References Cited

U.S. PATENT DOCUMENTS 1,437,904 A * 12/1922 Moomaw ..... B23P 6/02 123/193.2
1,730,905 A * 10/1929 Thomas ..... F04B 53/168 123/41.83
2,155,180 A 4/1939 Caldwell
2,640,434 A 6/1953 Leman
(Continued)

FOREIGN PATENT DOCUMENTS

GB 1470956 A * 4/1977 ..... F01B 1/14
GB 1599411 A * 9/1981 ..... F01L 33/02
(Continued)

*Primary Examiner* — Michael Leslie
*Assistant Examiner* — Matthew Wiblin
(74) *Attorney, Agent, or Firm* — Leydig, Voit & Mayer, Ltd.

(57) ABSTRACT

A hydraulic piston pump includes a reciprocal piston disposed in a blind housing bore of a piston housing to generate a pumping action. To accommodate the piston, a piston cartridge is installed in each of the housing bores. The piston cartridge includes a piston sleeve having an inner sleeve periphery, a first outer sleeve periphery, and a second outer sleeve periphery. The inner sleeve periphery is configured to establish sliding contact with the piston. The first outer sleeve periphery has a first outer sleeve diameter that is larger than a second outer sleeve diameter of the second outer sleeve periphery. To seal against the blind housing bore, a liner cap having a cylindrical liner wall and an axial liner cover is disposed over the first outer sleeve periphery. The axial liner cover abuts a housing bore ceiling of the blind housing bore and can receive hydraulic fluid there through.

12 Claims, 4 Drawing Sheets

(56) References Cited

U.S. PATENT DOCUMENTS

| | | | | | |
|---|---|---|---|---|---|
| 2,673,131 | A * | 3/1954 | Kistier | F16J 10/04 | 138/141 |
| 4,184,411 | A * | 1/1980 | Morris | F04B 53/168 | 220/378 |
| 4,620,475 | A * | 11/1986 | Watts | F01B 3/0047 | 29/888.02 |
| 4,893,738 | A | 1/1990 | Gelinas | | |
| 5,090,500 | A | 2/1992 | Yousef et al. | | |
| 5,860,798 | A | 1/1999 | Tschopp | | |
| 6,487,931 | B1 * | 12/2002 | Hara | F15B 11/20 | 417/269 |
| 6,588,318 | B2 | 7/2003 | Aday et al. | | |
| 9,353,775 | B2 | 5/2016 | Young | | |
| 2008/0020136 | A1 | 1/2008 | Ciolkosz et al. | | |
| 2015/0217745 | A1 | 8/2015 | Schuller et al. | | |
| 2016/0281690 | A1 | 9/2016 | Coldren et al. | | |

FOREIGN PATENT DOCUMENTS

| | | | | | |
|---|---|---|---|---|---|
| JP | 58-91301 | A | | 5/1983 | |
| JP | 59133869 | A | * | 8/1984 | F16J 10/04 |
| KR | 1020010082069 | | | 8/2001 | |

* cited by examiner

PISTON CARTRIDGE FOR PISTON PUMP

TECHNICAL FIELD

This patent disclosure relates generally to a hydraulic piston pump utilizing one or more pistons to displace fluid such as, for example, may be used in a cryogenic pump for delivering liquefied natural gas to an internal combustion engine.

BACKGROUND

Hydraulic piston pumps are hydro-mechanical devices that are used in a variety of applications to pressurize fluid for various uses. One particular application is in cryogenic pumps that pump liquefied natural gas ("LNG") to be combusted in an internal combustion engine. Recently, manufacturers of many mobile and stationary machines have occasionally configured those machines to combust alternative fuels such as LNG that may provide cost and/or environmental benefits over more traditional fossil fuel sources. Some cryogenic pumps are designed as structures that include a pump assembly at one end configured to be disposed in a cryogenic tank that maintains the fuel at cryogenic temperatures and a drive assembly at the other end which is disposed outside the tank and that is hydraulically activated to drive pumping elements in the pump assembly. The drive assembly may be configured as a piston drive having one or more reciprocating pistons supported in bores disposed in a piston housing. Various hydraulic configurations can be used to cause the pistons to reciprocate, which provides reciprocating motion that can be transmitted to the pump assembly to drive corresponding pumping elements disposed therein.

Cryogenic fuels may be stored under pressure and therefore the cryogenic pump may need to generate larger pressures to pressurize and direct the fuel from the storage tank to the engine. Because of the high pressures involved, the dimensions of the parts and clearances between parts may be critical and may need to be kept within close tolerances to prevent leakage while allowing relative motion of the parts, thereby requiring precision manufacturing of these parts. In addition, relative motion may cause the movable parts of cryogenic pump to wear overtime due to friction. It may become necessary to occasionally repair or overhaul the cryogenic pump for continued performance, which may be complicated by the need for close tolerances and precision machining. The present disclosure is directed to a particular configuration of a piston pump that may be suitable for use as the drive assembly in a cryogenic pump and that is adapted to facilitate and simplify manufacturing and maintenance.

SUMMARY

The disclosure describes, in one aspect, a hydraulic piston pump. To house the pistons, the hydraulic piston pump can include a piston housing having a plurality of housing bores that each defines a respective bore axis. The housing bores are configured as a blind bores and include a housing bore wall that axially terminates at a housing bore ceiling. A piston is accommodated in each of the plurality of housing bores to reciprocatingly move with respect to the bore axis. Also installed in each of the housing bores is a piston cartridge that includes a piston sleeve and a liner cap. The piston sleeve has an inner sleeve periphery delineating a sleeve bore and that is configured to establish sliding contact with the piston. The liner cap is disposed on the piston sleeve and has an axial liner cover that extends over the sleeve bore and that is configured to establish sealing contact with the housing bore ceiling.

In another aspect, there is disclosed a cartridge for accommodating a piston in a housing bore. The cartridge includes a piston sleeve extending between a first sleeve end and a second sleeve end. The piston sleeve further includes an inner sleeve periphery defining a sleeve bore and that is configured to reciprocating movement of the piston. The exterior of the piston sleeve can include a first outer sleeve periphery extending from the first sleeve end and a second outer sleeve periphery extending from the second sleeve end. The first outer sleeve periphery can have a first outer sleeve diameter that is larger than a second outer sleeve diameter associated with the second outer sleeve periphery. The cartridge also includes a liner cap having a cylindrical liner wall delineating a liner bore which receives the first outer sleeve periphery. The liner cap also includes an axial liner cover extending over the liner bore and which has a fluid aperture adapted to receive hydraulic fluid into the sleeve bore.

In a further aspect, the disclosure describes a cryogenic pump assembly in the form of a pump body extending along a pump axis between a pump assembly and a drive assembly. The pump assembly includes a plurality of pumping elements disposed radially around the pump axis. To drive the pumping elements, the drive assembly includes a piston housing having a plurality of housing bores disposed in a radial arrangement about the pump axis with each housing bore defining a bore axis. The piston housing further includes a plurality of fluid passages configured to direct fluid to one of the housing bores. A piston is accommodated in each of the housing bores and is arranged to reciprocatingly drive a corresponding pumping element in the pump assembly. To operatively interact with the pistons, a piston cartridge is concentrically installed in each of the plurality of housing bores that includes a piston sleeve and a liner cap. The piston sleeve has an inner sleeve periphery delineating a sleeve bore that is configured to establish sliding contact the piston. The liner cap includes an axial liner cover that extends over the sleeve bore and that has a fluid aperture to establish fluid communication with the fluid passage.

DETAILED DESCRIPTION

Figure 1:
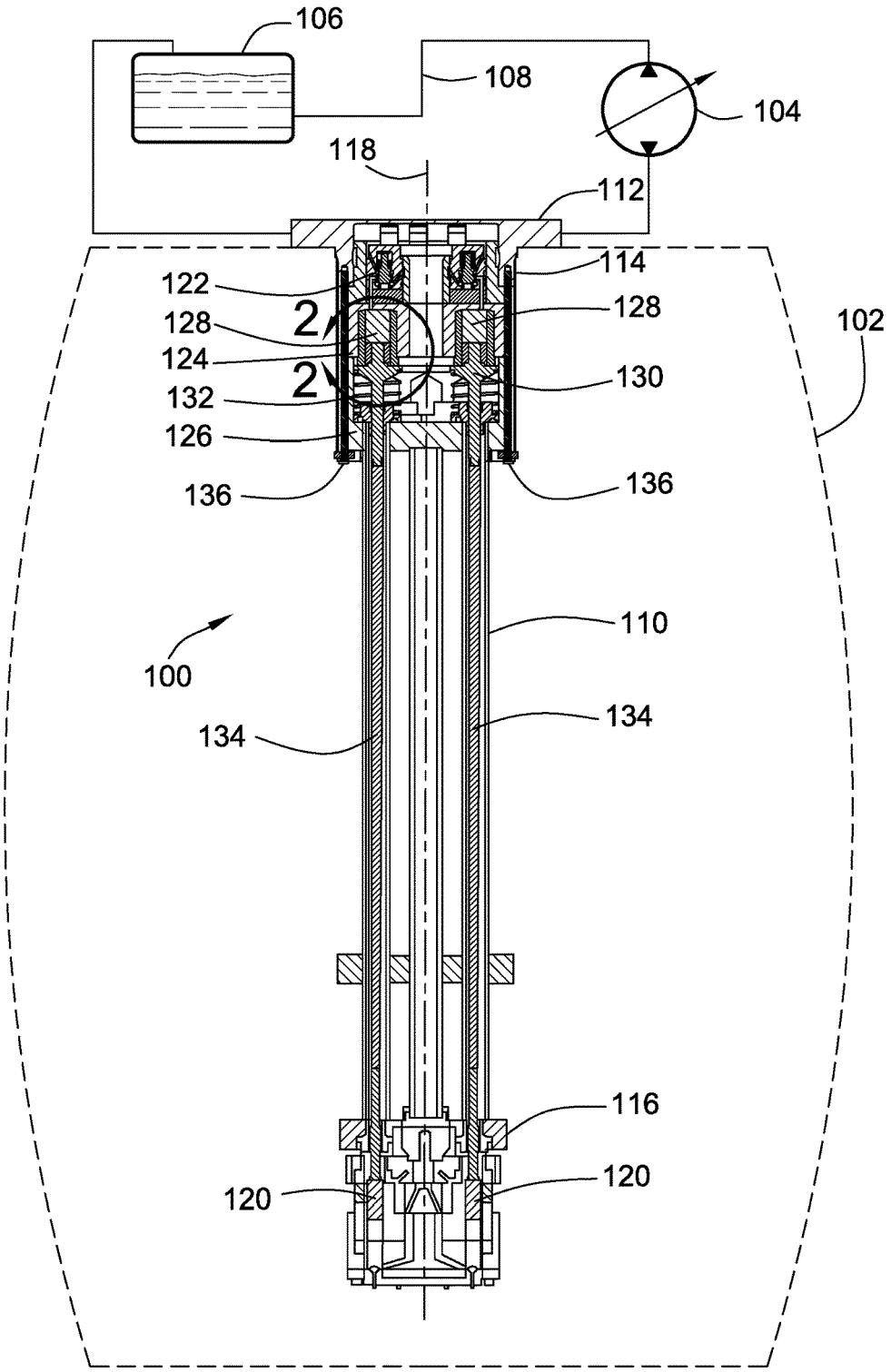
FIG. 1 is a cross-sectional view of a cryogenic pump disposed in a cryogenic tank and operatively associated with a hydraulic circuit that illustrates the components of a drive assembly and a submersible pump assembly.

This disclosure relates to a hydraulically driven piston pump for converting hydraulic fluid pressure into axial motion and particularly to a piston cartridge that accommodates and interacts with the pistons. While the disclosed piston pump is suited for use in a drive assembly on a cryogenic pump, it should be appreciated that aspects of the disclosure are applicable to various other applications and reference to a cryogenic pump is not intended as a limitation on the claims unless explicitly stated. Referring to FIG. 1, wherein like reference numbers refer to like elements, there is illustrated an embodiment of a cryogenic pump 100 partially disposed in a cryogenic tank 102 (illustrated in dashed lines) containing fuel such as a liquefied natural gas ("LNG") stored at cryogenic temperatures. For example, the fuel may be maintained at temperatures of minus 160° C. or lower and at pressures of between about 100 kilopascals (kPa) to about 1700 kilopascals (kPa). The cryogenic tank 102 may therefore be of a double-walled, vacuum-sealed construction like a Dewar flask and may be of any suitable size and storage volume. The cryogenic pump 100 can be hydraulically operated to further pressurize and direct the fuel to an internal combustion engine. To facilitate hydraulic operation, the cryogenic pump 100 can be operatively associated with a hydraulic circuit that can include a remote, fixed or variable displacement hydraulic pump 104 and a hydraulic reservoir 106 coupled to the cryogenic pump 100 via fluid conduits 108 in a closed loop. The hydraulic circuit also may include filters, heat exchangers, and other components to facilitate hydraulic operation of the cryogenic pump.

In the illustrated embodiment, the cryogenic pump 100 can be arranged vertically and can have a pump body 110 that extends into the cryogenic tank 102 from a pump flange 112 mounted in an externally exposed manner at the top of the cryogenic tank 102. To pump fuel, the cryogenic pump 100 includes a drive assembly 114 associated with the pump flange 112 and connected to the exterior of the tank and a pump assembly 116 disposed inside the cryogenic tank toward the bottom where it can be submerged in cryogenic fuel. The pump body 110 of the cryogenic pump 100 further defines a pump axis 118 extending between the drive assembly 114 and the pump assembly 116. When installed in the cryogenic tank 102, the pump axis 118 and the pump body 110 may be vertically oriented, although in other embodiments, other orientations of the cryogenic pump are possible. Furthermore, the arrangement enables the pump assembly 116 to remain submerged as the LNG level falls in the cryogenic tank 102.

To pressurize the fuel, the pump assembly 116 may include a plurality of pumping elements 120 in the form of reciprocating plungers adapted to move up and down with respect to the pump axis 118 and thereby generate a pumping action. The pumping elements 120 may move in a sequential and alternating manner to provide a consistent output of fuel from the cryogenic pump 100. In an embodiment, the pump assembly 116 may include six pumping elements 120 arranged concentrically about the pump axis 118, but in other embodiments, different numbers and arrangements of pumping elements 120 are contemplated and fall within the scope of the disclosure. The pumping elements 120 of the pump assembly 116 can be in fluid communication with a conduit or port (not shown) that exits from the cryogenic tank 102 to deliver fuel to the engine.

To drive the pumping elements 120, the drive assembly 114 may be configured as a linear hydraulic motor having a hydraulic piston in a cylinder that converts the hydraulic pressure from the hydraulic pump 104 into reciprocating motion that is directed generally parallel with the pump axis 118. The conversion of hydraulic pressure to reciprocating motion is accomplished by interoperation of the components of the drive assembly 114. Those components may include an actuator or spool valve housing 122 located underneath the pump flange 112, a piston housing 124 arranged vertically below the spool valve housing 122, and a spring housing 126 disposed vertically below the piston housing 124. The piston housing 124 can include a plurality of pistons 128 disposed and configured to reciprocate within corresponding bores disposed in the piston housing 124. In an embodiment, the piston housing 124 may include six pistons 128 that are radially arranged in a corresponding number of bores about the pump axis 118; however, in other embodiments, alternative numbers and arrangements of pistons 128 in the piston housing 124 are contemplated.

The spring housing 126 can accommodate a plurality of pushrods 130 that are urged by springs 132 upward against the lower end of the pistons 128. In operation, hydraulic pressure directed to the drive assembly 114 from the hydraulic pump 104 can force the pistons 128 downward displacing the pushrods 130 against the springs 132, and the springs 132 may urge the pushrods 130 and their associated pistons 128 upwards when the hydraulic pressure is reduced or eliminated. To transmit the reciprocating motion of the pistons 128 and pushrods 130 in the drive assembly 114 to the pump assembly 116, a plurality of connecting rods 134 can be included in the pump body 110 that extend between the pushrods 130 and the pumping elements 120. The reciprocating motion imparted to the connecting rods 134 can therefore drive the pumping elements 120 in the same reciprocating manner. To hold the different components of the drive assembly 114 together, one or more threaded fasteners 136 can extend through and interconnect the components in a manner that allows for disassembly and repair.

Figure 2:
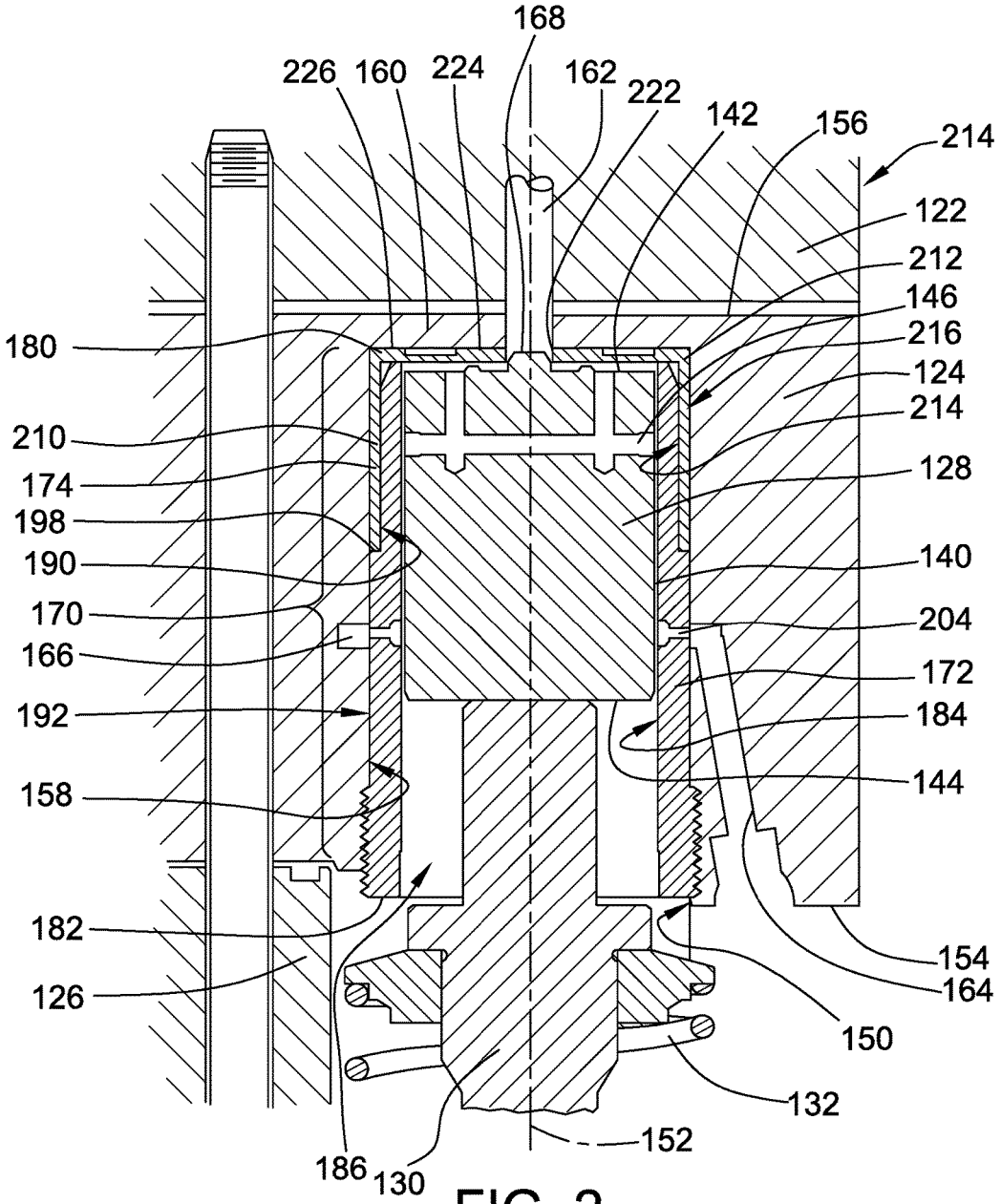
FIG. 2 is a detailed view of the portion of the drive assembly indicated by detail 2-2 in FIG. 1 illustrating a piston reciprocatingly disposed in a piston housing and movable within a piston cartridge designed in accordance with the disclosure.

Referring to FIG. 2, there is illustrated in closer detail an embodiment of a piston 128 reciprocatingly disposed in the piston housing 124 of the drive assembly 114. The pistons 128, sometimes referred to as tappets, may have a cylindrical piston body 140 that extends between a first piston end 142 and a second piston end 144 opposite the first piston end 142. The piston body 140 further can have a height that is defined between the first piston end 142 and the second piston end 144. The piston 128 may also include one or more fluid channels 146 disposed therein that extend from the first piston end 142 axially into the cylindrical piston body 140, then extend laterally out of the cylindrical exterior defined by the piston body 140. The piston 128 can be made from any suitable rigid material such as metal or ceramic.

To accommodate the piston 128, the piston housing 124 can have a housing bore 150 disposed into the material of the piston housing 124 which can have a cylindrical shape similar to the piston 128 and can be sized slightly larger in diameter than the piston 128. The housing bore 150 thus extends along and defines a bore axis 152 that may be parallel with and spaced apart from the pump axis 118 of FIG. 1. More specifically, the housing bore 150 may be a blind bore that is disposed from the bottom housing face 154 of the piston housing 124 partway towards the top housing face 156. The housing bore 150 therefore defines a cylindrical housing bore wall 158 that terminates at a housing bore ceiling 160 that may be proximate to the top housing face 156. The housing bore ceiling 160 may extend over the housing bore 150 and be perpendicular to the bore axis 152. As indicated, a plurality of housing bores 150 may be disposed into the piston housing 124 radially offset from the pump axis and angularly arranged to accommodate the corresponding plurality of pistons 128. Further, the axial height of the blind housing bore 150 with respect to the bore axis 152 can be larger than the height of the piston 128 so that the piston 128 can reciprocate within the housing bore 150 along the bore axis 152 during operation. As described above, when the piston 128 is moved downwardly during a pumping stroke, the second piston end 144 of the piston body 140 is forced against and displaces a pushrod 130 located in the spring housing 126. The pushrod 130 is therefore urged against and compresses the spring 132 located in the spring housing 126.

To cause the piston 128 to axially reciprocate in the housing bore 150, the piston housing 124 can be configured to establish and selectively direct pressurized hydraulic fluid from the hydraulic circuit to the appropriate housing bores 150 during operation. To establish fluid communication with the housing bore 150, one or more fluid passages 162 are disposed into the piston housing 124 and can open into the housing bore 150 through the housing bore ceiling 160. In the illustrated embodiment, the fluid passage 162 is aligned with the bore axis 152 but in other embodiments may be disposed elsewhere. The fluid passage 162 can also be in fluid communication with one or more valves, such as solenoid valves or spool valves, which are disposed between the piston housing 124 and the hydraulic pump. The piston housing 124 and fluid passages 162 therein function as a manifold that operate in cooperation with the aforementioned valves to selectively direct the pressurized hydraulic fluid to the housing bores 150 in a controlled manner. When the hydraulic fluid enters the housing bore 150 from the fluid passage 162, it impinges on the first piston end 142 forcing the piston 128 downwards with respect to the bore axis 152 and filling the housing bore 150 with fluid. When the flow of fluid is shut off, the spring 132 disposed below the pushrod 130 can recover its uncompressed length thereby urging the piston 128 upwards against the housing bore ceiling 160. The fluid may be directed back through the fluid passage 162 to a drain opening created by one of the aforementioned valves.

The piston housing 124 and the piston 128 can include additional features to facilitate interoperation of the reciprocating piston 128 and the pressurized hydraulic fluid. For example, as stated above, the piston 128 can have one or more fluid channels 146 disposed through it that establish fluid communication through the piston body 140 from the first piston end 142 radially outward through the cylindrical exterior of the piston body 140. These fluid channels 146 may assist in controlling the axial stroke of the piston 128 by relieving hydraulic pressure in the housing bore 150. For example, to cooperate with the fluid channels 146, a discharge channel 164 can be disposed into the bottom housing face 154 partway into the piston housing 124 and that can communicate with an annular groove 166 disposed circumferentially around the housing bore 150. The annular groove 166 may be axially located with respect to the bore axis 152 to establish the stroke distance of the piston 128 in the housing bore 150. When the piston 128 is fully displaced axially downward, the fluid channels 146 may align and communicate with the annular groove 166 to direct fluid from the housing bore 150 to the discharge channel 164. That relieves the hydraulic pressure in the housing bore 150 and allows the spring 132 to stop the downward motion of the piston 128 in the housing bore ceiling 160, thereby helping establishing the stroke distance of the piston 128.

In a further embodiment, the piston 128 can include a boss 168 projecting from the first piston end 142 that can be centered with respect to the bore axis 152 and can align with the fluid passage 162 disposed through the housing bore ceiling 160. When the piston 128 is urged fully upward against the housing bore ceiling 160, the boss 168 can be received in the fluid passage 162 to block the further flow of hydraulic fluid into the housing bore 150.

To enable the piston 128 to reciprocatingly move within the housing bore 150, the clearance between the cylindrical piston body 140 and housing bore wall 158 typically must be very close and held within tight tolerances. Parallel alignment of the bore axis 152 with the pump axis 118 may be important to ensure the force caused by motion of the pistons 128 is directed to the pumping elements 120 in the pump assembly 116. This may complicate machining a plurality of blind housing bores 150 in a radially offset arrangement into the piston housing 124 that may be cast from a relatively hard material. The depth of the blind housing bore 150 may be important as it establishes in part the piston stroke distance. Further, the piston bodies 140 and the respective housing bores 150 may frictionally wear over time, necessitating occasional repair or replacement.

To facilitate manufacturing and/or repair of the drive assembly 114, a hydraulic piston cartridge 170 can be installed in the housing bore 150 and is precision machined to closely match the dimensions of the piston 128. The hydraulic piston cartridge 170 can include a piston sleeve 172 and a liner cap 174 that, when assembled together in the housing bore 150 and concentrically aligned with bore axis 152, provides the matched or machined surfaces along which the piston 128 can reciprocatingly move.

Figure 3:
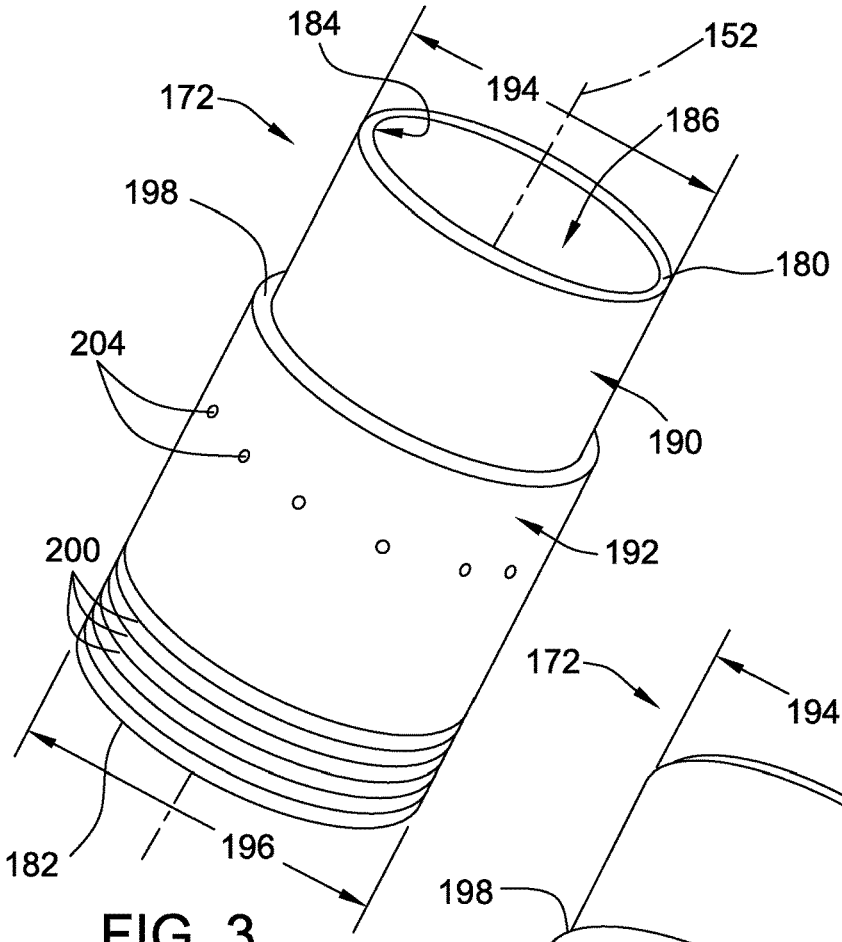
FIG. 3 is a top perspective view of an embodiment of the piston sleeve of the piston cartridge illustrating the first outer sleeve periphery and a sleeve bore disposed into the first sleeve end of the piston sleeve.
Figure 4:
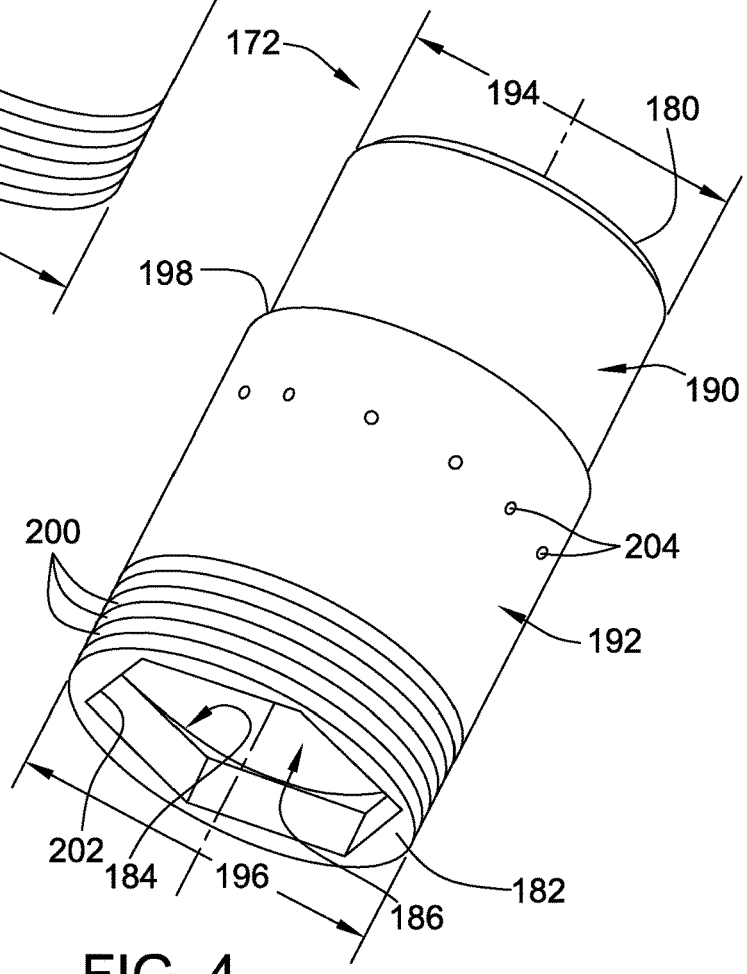
FIG. 4 is a bottom perspective view of the embodiment of a piston sleeve illustrating a second outer sleeve periphery and a second sleeve end with male threads for securing the piston sleeve in the piston housing.

More specifically, referring to FIGS. 2, 3, and 4, the piston sleeve 172 of the piston cartridge 170 may have a cylindrically tubular configuration that is intended to enable the piston 128 to move within or slide within the piston sleeve 172. The piston sleeve 172 can extend between a first sleeve end 180 and an opposite second sleeve end 182 and includes an inner sleeve periphery 184 that corresponds to the inner cylindrical diameter and that defines a sleeve bore 186 to receive the piston 128. The inner sleeve periphery 184 can be machined, precision ground, or honed so that the inner sleeve periphery 184 forms a matched fit with the piston body 140 of the piston 128. The inner sleeve periphery 184 may therefore have a smooth, highly polished finish with very low surface roughness. To facilitate manufacturability and to maintain the set tolerances of the sleeve bore 186 during operation, the piston sleeve 172 can be made of a relatively hard material such as steel.

The exterior of the piston sleeve 172 can have varying widths or diameters in order to facilitate assembly with the liner cap 174 of the piston cartridge 170. More specifically, the exterior of the piston sleeve 172 can include a first outer sleeve periphery 190 disposed toward the first sleeve end 180 and a second outer sleeve periphery 192 disposed toward the second sleeve end 182. The first and second outer sleeve peripheries 190, 192 may be concentric to each other and are arranged in an axially abutting relation. The first outer sleeve periphery 190 can have a first outer sleeve diameter 194 that is generally smaller in dimension than the second outer sleeve diameter 196 associated with the second outer sleeve periphery 192. Because of the difference between the first outer sleeve diameter 194 and the second outer sleeve diameter 196, the piston sleeve 172 can have a stepped configuration including a sleeve shoulder 198 where the first outer sleeve periphery 190 and the second outer sleeve periphery 192 intersect. Further, the second outer sleeve diameter 196 can have substantially the same dimension as the diameter of the housing bore 150 so that the second outer sleeve periphery 192 and the housing bore wall 158 contact each other when the piston sleeve 172 is installed in the housing bore 150.

To secure the piston sleeve 172 within the piston housing 124, the second outer sleeve periphery 192 can have formed thereon a plurality of external male threads 200. The male threads 200 on the second sleeve outer periphery 192 can threadably engage with matching female threads that can be formed on the bottom of the housing bore wall 158 proximate to the bottom housing face 154. To facilitate engagement of the male threads 200, the piston sleeve 172 can have an engagement feature such as a hexagonal socket 202 disposed into the second sleeve end 182 that can receive a correspondingly shaped driver such as an Allen wrench. Engaging the driver with the hexagonal socket 202 enables one to rotate the piston sleeve 172 relative to the housing bore wall 158 so the male threads 200 securely fasten the piston sleeve 172 concentrically within the housing bore 150. The male threads 200 can extend along any suitable axial length of the second outer sleeve periphery 192 but, in the illustrated embodiment, the male threads 200 are located only proximate to the second sleeve end 182 so that the remainder of the axial length of the second outer sleeve periphery 192 has a smooth exterior surface.

Because insertion of the piston sleeve 172 into the housing bore 150 could block access to the annular groove 166 communicating with the discharge channel 164, the piston sleeve 172 can have a plurality of radial orifices 204 axially positioned between the first sleeve end 180 and the second sleeve end 182 to correspond with the axial location of the annular groove 166. The radial orifices 204 thereby establish fluid communication with the sleeve bore 186 by way of the fluid channel 146 in the piston body 140 and the annular groove 166 disposed in the piston housing 124. In the illustrated embodiment, the radial orifices 204 may be axially positioned to extend through the smooth portion of the second outer sleeve periphery 192 so that direct contact between the housing bore wall 158 and the second outer sleeve periphery 192 establishes and aligns the interface between the radial orifices 204 and the annular groove 166.

As indicated above, to enable both the piston sleeve 172 and the liner cap 174 to be inserted into the housing bore 150, the first and second outer sleeve peripheries 190, 192 can be configured to mate with the liner cap 174 and position the liner cap 174 intermediately between the piston sleeve 172 and the housing bore wall 158. Specifically, because of the smaller first outer sleeve diameter 194 associated with the first outer sleeve periphery 190, it can be appreciated that a radial gap or space may be exist between the first outer sleeve periphery 190 and the housing bore wall 158 when the piston sleeve 172 is inserted into the housing bore 150. The radial gap may be axially coextensive with the axial length of the first outer sleeve periphery 190 and terminates at the sleeve shoulder 198 where the first outer sleeve periphery 190 and second outer sleeve periphery 192 intersect. The radial gap between the first outer sleeve periphery 190 and the housing bore wall 158 can accommodate the liner cap 174 and concentrically position the liner cap 174 within the housing bore 150.

Figure 5:
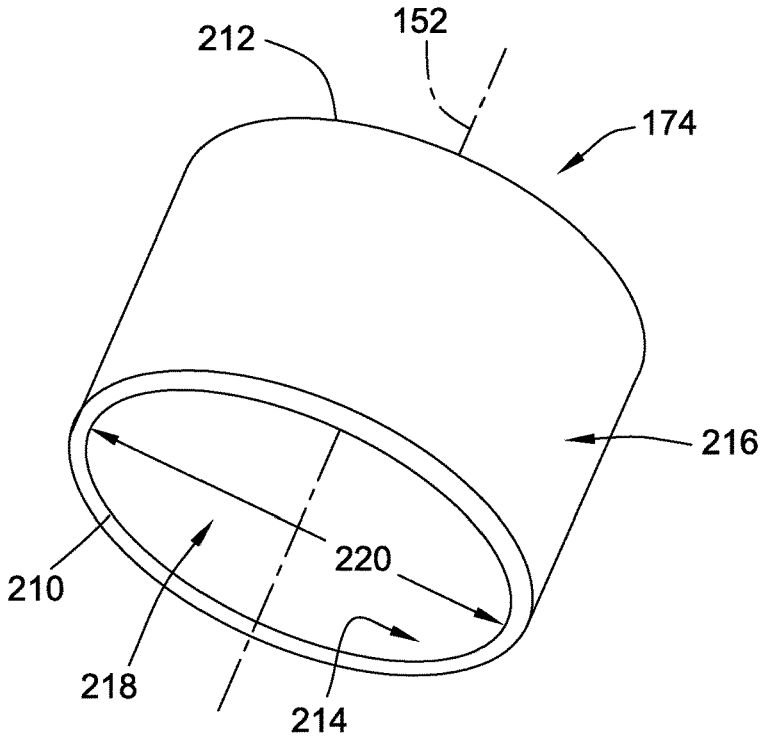
FIG. 5 is a bottom perspective view of an embodiment of a liner cap of the piston cartridge illustrating a liner bore radially defined within the cylindrical liner wall.
Figure 6:
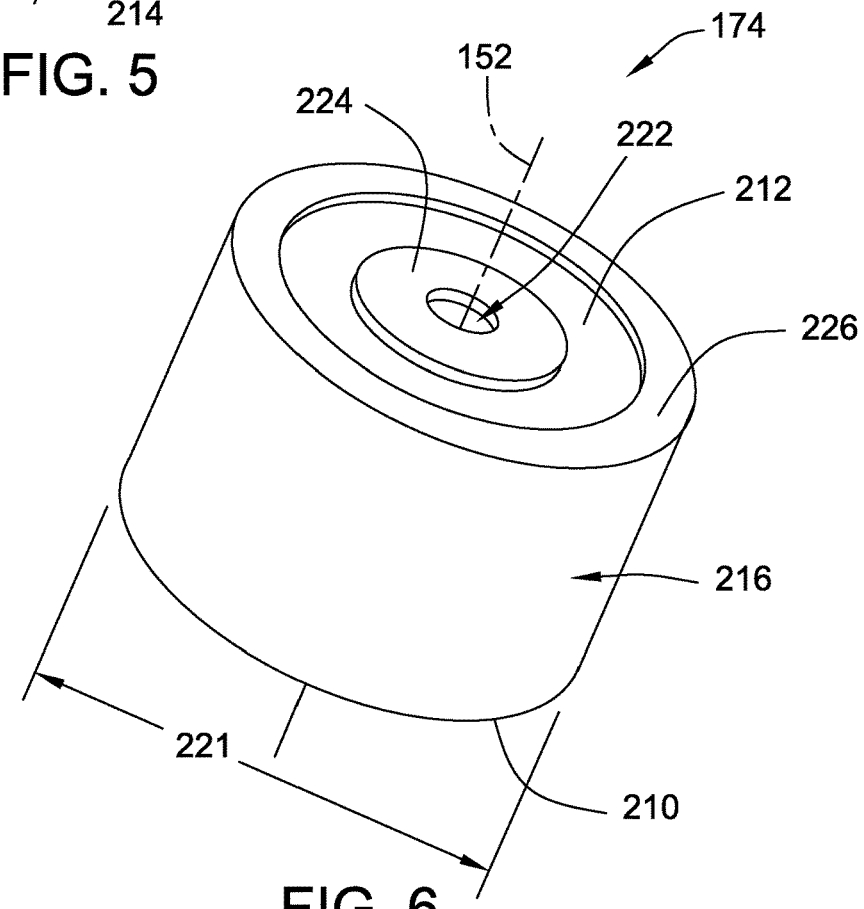
FIG. 6 is a top perspective view of the liner cap illustrating the profile of the liner cap that extends over the liner bore.

Specifically, referring to FIGS. 2, 5, and 6, the liner cap 174 can be formed to fit over the first outer sleeve periphery 190. The liner cap 174 may include a cylindrical liner wall 210 that is tubular in configuration and that terminates at one end in an axial liner cover 212. The cylindrical liner wall 210 includes an inner liner cylindrical periphery 214 and an outer liner cylindrical periphery 216. The inner liner cylindrical periphery 214 further defines a liner bore 218 that is closed off at one end by the axial liner cover 212. The liner bore 218 is adapted to receive the portion of the piston sleeve 172 proximate the first sleeve end 180 and has a liner bore diameter 220 substantially corresponding to the first outer sleeve diameter 194 associated with the first outer sleeve periphery 190. Accordingly, to assemble the piston cartridge 170, the first sleeve end 180 can be inserted into the liner bore 218 with the inner liner cylindrical periphery 214 circumferentially adjacent to the first outer sleeve periphery 190. When the assembled piston cartridge 170 is installed in the housing bore 150, the cylindrical liner wall 210 is disposed intermediately between the piston sleeve 172 and the housing bore wall 158 while the axial liner cover 212 is positioned axially adjacent to the housing bore ceiling 160. To enable the liner cap 174 to conform to the space between the piston sleeve 172 and the housing bore 150, the liner cap 174 can be made from a relatively softer or more malleable material than the piston sleeve 172, such as copper.

To interface with the housing bore wall 158 of the housing bore 150, the outer liner cylindrical periphery 216 can have a smooth exterior surface and can have an outer liner diameter 221 dimensioned to generally correspond to the diameter of the housing bore wall 158. Hence, the outer liner cylindrical periphery 216 can make sliding contact with the housing bore wall 158 when the assembled piston cartridge 170 is installed in the housing bore 150. In an embodiment, the end of the cylindrical liner wall 210 may be positioned above the sleeve shoulder 198. However, in another possible embodiment, the axial length of the cylindrical liner wall 210 can correspond with the axial extension of the first outer sleeve periphery 190 on the piston sleeve 172 so that the end of the cylindrical liner wall 210 opposite the axial liner cover 212 can axially abut the sleeve shoulder 198 during installation. The outer liner diameter 221 may correspond in dimension with the second outer sleeve diameter 196 of the second outer sleeve periphery 192 so the assembled piston cartridge 170 has an overall consistent cylindrical shape of the same diameter. The corresponding shapes and dimensions between the first outer sleeve periphery 190 of the piston sleeve 172 and the cylindrical liner wall 210 of the liner cap 174 may cooperate to guide and appropriately position the liner cap 174 within the housing bore 150 proximate to the housing bore ceiling 160.

Because the pressurized hydraulic fluid enters the housing bore 150 via the fluid passage 162 disposed through the housing bore ceiling 160, the axial liner cover 212 of the liner cap 174 can include features to facilitate direction of the hydraulic fluid into the sleeve bore 186 of the piston sleeve 172 to impinge on the piston 128. For example, to establish fluid communication between the fluid passage 162 in the piston housing 124 and the sleeve bore 186, the axial liner cover 212 can have a centrally located fluid aperture 222 disposed therein. The fluid aperture 222 can concentrically align with the fluid passage 162 along the bore axis 152 and can be dimensioned to operatively interact with the boss 168 on the piston 128. For example, the boss 168 and the fluid aperture 222 can have corresponding chamfers or similar features to facilitate mating and to selectively seal fluid communication with the fluid passage 162.

The axial liner cover 212 can also be shaped or contoured with features to interface with the housing bore ceiling 160 to prevent leakage around the piston cartridge 170. For example, referring to FIGS. 4 and 5, the axial liner cover 212 can have an inner annular land 224 and an outer annular land 226 concentrically disposed around the fluid aperture 222 at the upper most surface of the axial liner cover 212. When the axial liner cover 212 is axially adjacent to the housing bore ceiling 160, the inner and outer annular lands 224, 226 may directly abut and press against housing bore ceiling 160. More particularly, the outer annular land 226 urged upwards by installation of the piston sleeve 172 into the housing bore 150 can form a sealed interface proximate where the housing bore ceiling 160 and the housing bore wall 158 intersect.

To further resist leakage around the piston cartridge 170, the axial length of the piston sleeve 172 with respect to the housing bore 150 can be configured so the first sleeve end 180 compresses the axial liner cover 212 against the housing bore ceiling 160 and urges the components together. The upward force directed through the outer annular land 226 can concentrate the axial compressive load to increase sealing pressures between the annular land 226 and the housing bore ceiling 160. In an embodiment, to promote compressive interaction between piston sleeve 172 and the axial liner cover 212, the first sleeve end 180 can be tapered or ground to have a partially pointed, knife-like edge that further concentrates the axial compressive forces toward, for example, the outer annular land 226 of the axial liner cover 212. The softer material of the liner cap 174 may allow it to deform or conform about the first sleeve end 180 and against the housing bore ceiling 160 to promote sealing. In another embodiment, to create a radial seal between the piston cartridge 170 and the housing bore 150, the axial length of the cylindrical liner wall 210 may be slightly greater than the axial length of the first outer sleeve periphery 190 between the first sleeve end 180 and the sleeve shoulder 198. When installed, the axial distance between the first sleeve end 180 and the sleeve should 190 can cause the cylindrical liner wall 210 to distort radially outward placing the outer liner cylindrical periphery 216 in circumferential contact with housing bore wall 158.

INDUSTRIAL APPLICABILITY

Inclusion of the piston cartridge facilitates construction and maintenance of a hydraulically driven piston pump having a plurality of pistons reciprocatingly disposed in a piston housing to provide a pumping action, such as may be needed to pump cryogenically stored fuels in a cryogenic pump. In particular, the plurality of housing bores 150 can be disposed into the piston housing 124 with relatively reduced precision and the piston cartridges 170 can assume the tight tolerances and clearances required for the hydraulically actuated, reciprocating movement of the pistons 128. This facilitates manufacturing because the smaller components of the piston cartridge 170 are easier to machine including, for example, the step of honing or precision grinding the sleeve bore 186 disposed into the piston sleeve 172 to form a closely toleranced, clearance fit with the piston body 140 of the piston 128 slidably disposed therein. Further, the piston cartridge 170 may allow for a degree of axial misalignment of the components with respect to the bore axis 152 because the axial extension of the inner sleeve periphery 184 guides the reciprocating motion of the piston body 140, regardless of whether the piston sleeve 172 and piston 128 are axially alignment with the bore axis 152.

The liner cap 174 prevents unintended leakage around the piston cartridge 170 and into the surrounding housing bore 150 of the piston housing 124. Specifically, the liner cap 174 can be matingly disposed over the first sleeve end 180 of the piston sleeve 172 and is guided by the piston sleeve 172 into position within the housing bore 150 during installation of the piston cartridge 170. When installed, the axial liner cover 212 of the liner cap 174 is adjacent to and abuts against the housing bore ceiling 160. Further, the concentric arrangement of the first outer sleeve periphery 190 of the piston sleeve 172 and the inner liner cylindrical periphery 214 of the cylindrical liner wall 210 aligns and locates the fluid aperture 222 with the fluid passage 162. Continued axial insertion of the piston cartridge 170 into the housing bore 150, for example, by rotation of the piston sleeve 172 threadably engaged with the housing bore 150 via the male threads 200, axially compresses and thrusts the axial liner cover 212 into sealing engagement with the housing bore ceiling 160. Because contact may occur primarily between the inner and outer annular lands 224, 226 and the housing ceiling 160, the sealing pressure between these components is focused and concentrated. Further, the axially adjacent arrangement of the components provides a first sealing interface between the first sleeve end 180 and the axial liner cover 212 and a second sealing interface between the inner and outer annular lands 224, 226 and the housing bore ceiling 160. Abutting the piston sleeve 172 against the liner cap 174 can also ensure axial alignment of the radial orifices 204 with the annular groove 166 thereby in part establishing the stroke distance of the piston 128 in the housing bore 150.

Additionally, the softer, malleable material of the liner cap 174, as compared to the piston sleeve 172, may allow it to plastically deform or conform to the radial and axial spaces between the piston sleeve 172, the housing bore wall 158, and the housing bore ceiling 160. Threaded engagement of the male threads 200 and firm rotation of the piston sleeve 172 relative to the housing bore 150 may generate the forces necessary to cause material displacement of the liner cap 174 into these spaces. Moreover, deformation of the liner cap 174 may reinforce the axial load between the piston sleeve 172 and the piston housing 124. The axial load may ensure that the piston sleeve 172 is securely engaged within the housing bore 150 over multiple cycles of hydraulically charging and discharging fluid to reciprocatingly move the piston 128. The compressive material of the liner cap 174 and its loading characteristics may also prevent the male threads 200 on the piston sleeve 172 from unintentionally disengaging with the corresponding threads in the housing bore 150.

Because the liner cap 174 may be deformed during assembly, the liner cap 174 can be characterized as a sacrificial replacement component of the piston cartridge 170. Specifically, during reassembly, the piston cartridge 170 may be uninstalled and the deformed liner cap 174 removed from the housing bore 150, discarded, and replaced with a new liner cap 174 that is again guided into position by installation of the piston sleeve 172 into the housing bore 150. The shape and configuration of the liner cap 174 allow it to be formed by a drawing or forging process, simplifying its manufacturability as compared to the precision-machined piston sleeve 172. Hence, the same piston sleeve 172, and possibly the same piston 128 can be reused several times with the replaceable liner cap 174 deforming to seal the piston cartridge 170 within the housing bore 150.

In a further embodiment, the piston cartridge 170 can enable selective matching of the pistons 128 with piston sleeves 172 during assembly. For example, piston bodies 140 made with diameters corresponding toward one point of a manufacturing tolerance range can be matched with piston sleeves 172 having sleeve bores 186 similarly corresponding toward that point in the tolerance range. Selectively matching or pairing of pistons 128 and piston sleeves 172 ensures a close sliding fit occurs between components of similar dimensions while allowing for broader manufacturing tolerances during the machining operations.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A cryogenic pump assembly comprising:

a pump body extending along a pump axis between a pump assembly and a drive assembly;

the pump assembly including a plurality of pumping elements disposed radially around the pump axis;

the drive assembly including a piston housing having:

a plurality of housing bores disposed in a radial arrangement about the pump axis, a plurality of pistons, a plurality of fluid passages, and a plurality of piston cartridges;

wherein each one of the plurality of housing bores defines a corresponding bore axis, accommodates a corresponding piston of the plurality of pistons, receives fluid from a corresponding fluid passage of the plurality of fluid passages, and has concentrically installed therein a corresponding piston cartridge of the plurality of piston cartridges;

wherein each one of the plurality of pistons is arranged to reciprocally drive a corresponding one of the plurality of pumping elements; and wherein each one of the plurality of piston cartridges includes a piston sleeve and a liner cap, the piston sleeve having an inner sleeve periphery delineating a sleeve bore and configured to establish sliding contact with one of the plurality of pistons, the liner cap including an axial liner cover extending over the sleeve bore and a fluid aperture configured to establish fluid communication with one of the plurality of fluid passages.

2. The cryogenic pump assembly of claim 1, wherein each of the plurality of housing bores is configured as a blind bore including a housing bore wall axially terminating at a housing bore ceiling, and the axial liner cover of the liner cap further includes an annular land to provide sealing contact with the housing bore ceiling.

3. The cryogenic pump assembly of claim 2, wherein the piston sleeve includes a plurality of radial apertures disposed therein and axially positioned to communicate with a groove disposed in the housing bore wall.

4. The cryogenic pump assembly of claim 3, wherein each of the plurality of fluid passages is disposed through the corresponding housing bore ceiling of the corresponding housing bore.

5. The cryogenic pump assembly of claim 4, wherein the annular land is an inner annular land disposed circumferentially proximate to a corresponding one of the plurality of fluid passages, and the axial liner cover includes an outer annular land disposed circumferentially about the inner annular land.

6. The cryogenic pump assembly of claim 5, wherein the piston sleeve axially extends between a first sleeve end and a second sleeve end, the first sleeve end pressing the axial liner cover adjacent the corresponding housing bore ceiling.

7. The cryogenic pump assembly of claim 6, wherein the piston sleeve includes a first outer sleeve periphery proximate the first sleeve end and a second outer sleeve periphery proximate the second sleeve end.

8. The cryogenic pump assembly of claim 7, wherein the first outer sleeve periphery has a first outer sleeve diameter and the second outer sleeve periphery has a second outer sleeve diameter that is larger than the first outer sleeve diameter.

9. The cryogenic pump assembly of claim 8, wherein the liner cap includes a cylindrical liner wall extending from the axial liner cover, the cylindrical liner cover circumferentially disposed around the first outer sleeve periphery.

10. The cryogenic pump assembly of claim 9, wherein cylindrical liner wall has an outer liner diameter corresponding to the second outer sleeve diameter.

11. The cryogenic pump assembly of claim 1, wherein the piston sleeve is made of a relatively harder material than the liner cap such that the liner cap physically deforms between the first sleeve end and the housing bore ceiling.

12. The cryogenic pump assembly of claim 1, wherein the piston sleeve includes a plurality of male threads disposed proximate the second sleeve end to engage corresponding female threads in each of the plurality of housing bores.

* * * * *